United States Patent [19]

Meyer

[11] 4,235,444

[45] Nov. 25, 1980

[54] TARGET PARTICULARLY FOR ARCHERY

[76] Inventor: Leonard S. Meyer, 6449 Bridgewood Rd., Columbia, S.C. 29206

[21] Appl. No.: 941,290

[22] Filed: Sep. 11, 1978

Related U.S. Application Data

[63] Continuation-in-part of Ser. No. 726,201, Sep. 24, 1976, Pat. No. 4,121,959, which is a continuation-in-part of Ser. No. 631,893, Nov. 14, 1975, Pat. No. 4,076,246, which is a continuation-in-part of Ser. No. 533,942, Dec. 18, 1974, abandoned.

[51] Int. Cl.[3] ..... F41J 3/00

[52] U.S. Cl. ..... 273/403; 273/408; 273/DIG. 4; 273/DIG. 6

[58] Field of Search ..... 273/102 B, DIG. 4, DIG. 6, 273/403, 408; 428/911, 912

[56] References Cited

U.S. PATENT DOCUMENTS

| | | | |
|---|---|---|---|
| 2,360,525 | 10/1944 | Sperry | 428/912 |
| 2,405,986 | 8/1946 | Sullivan | 428/912 |
| 2,406,679 | 8/1946 | Gray et al. | 428/912 |
| 2,812,947 | 11/1957 | Fatzinger et al. | 273/102 B |
| 3,000,772 | 9/1961 | Lunn | 428/911 |
| 3,048,401 | 8/1962 | Dishon | 273/102 B |
| 3,127,135 | 3/1964 | Burr et al. | 428/492 |
| 3,367,660 | 2/1968 | DiMaggio | 273/102 B |
| 3,476,390 | 11/1969 | Roloft et al. | 273/102 B |
| 3,509,016 | 4/1970 | Underwood et al. | 428/911 |
| 4,066,261 | 1/1978 | Stewart | 273/102 B |

FOREIGN PATENT DOCUMENTS

| | | | |
|---|---|---|---|
| 118104 | 2/1944 | Australia | 428/912 |
| 706287 | 3/1965 | Canada | 273/102 B |

*Primary Examiner*—Paul E. Shapiro

*Attorney, Agent, or Firm*—Kenneth P. Synnestvedt

[57] ABSTRACT

A target made of interchangeable sections each comprising a multiplicity of membranes or plies of penetrable, elastomeric or resistant, tear resistant sheet resin material, the membranes being separated by intervening layers of porous or low density, resilient material such as foam resin material. Membranes are disclosed having opposite surfaces with different coefficients of friction.

8 Claims, 27 Drawing Figures

FIG 7
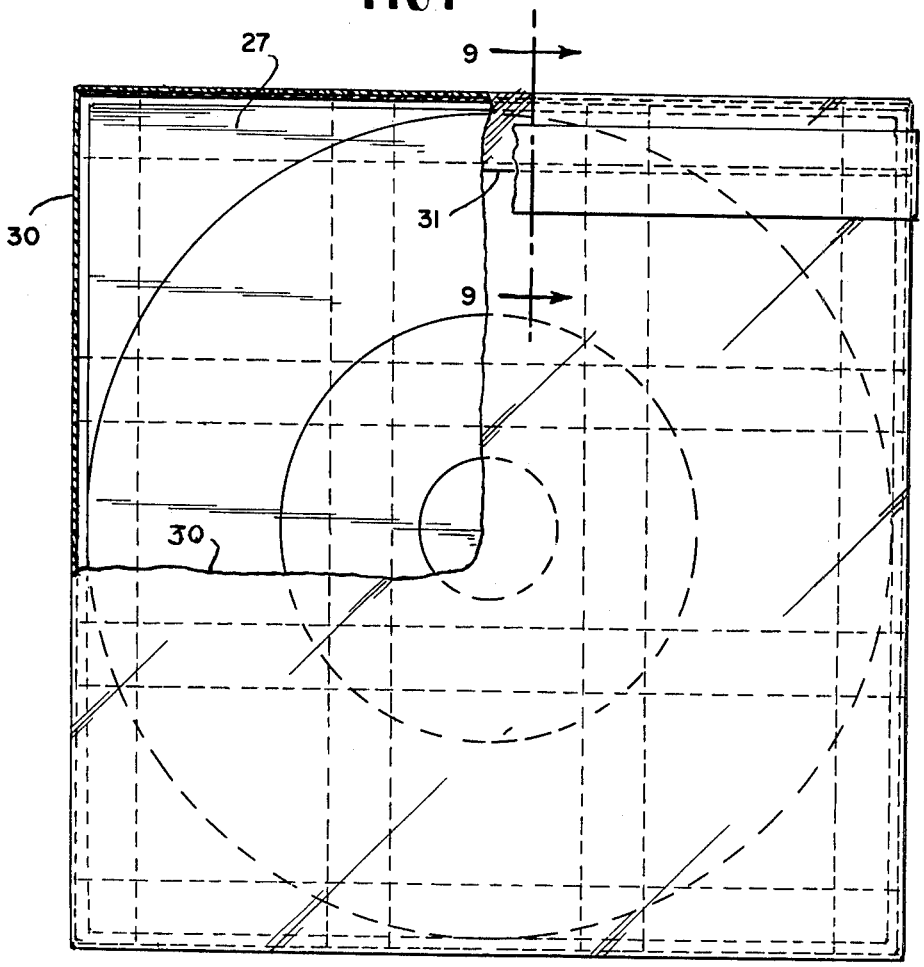
FIG 8
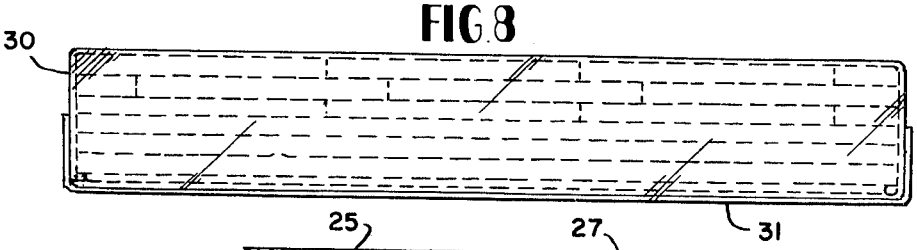
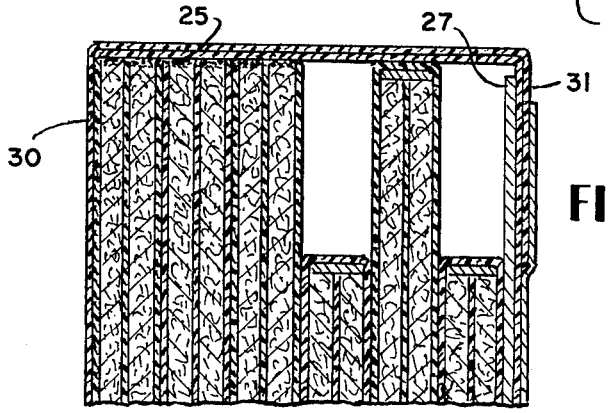
FIG 9

FIG. 12
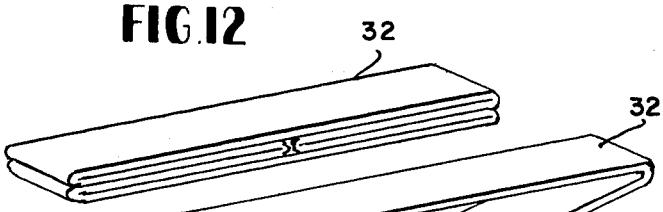
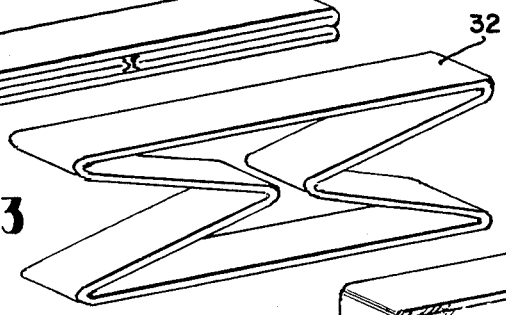
FIG. 13
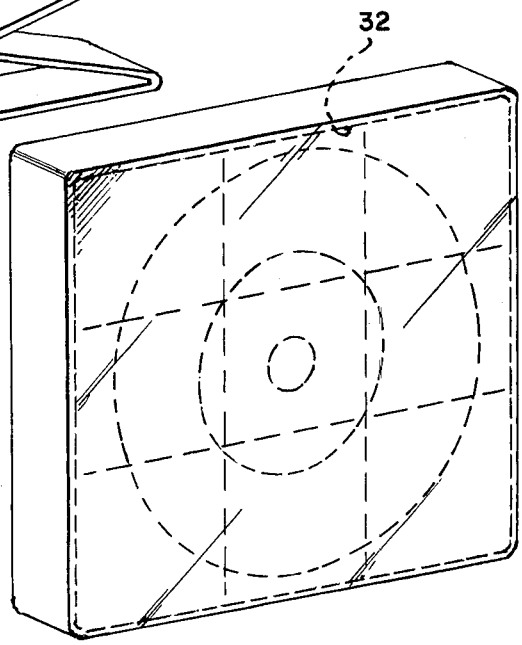
FIG. 14
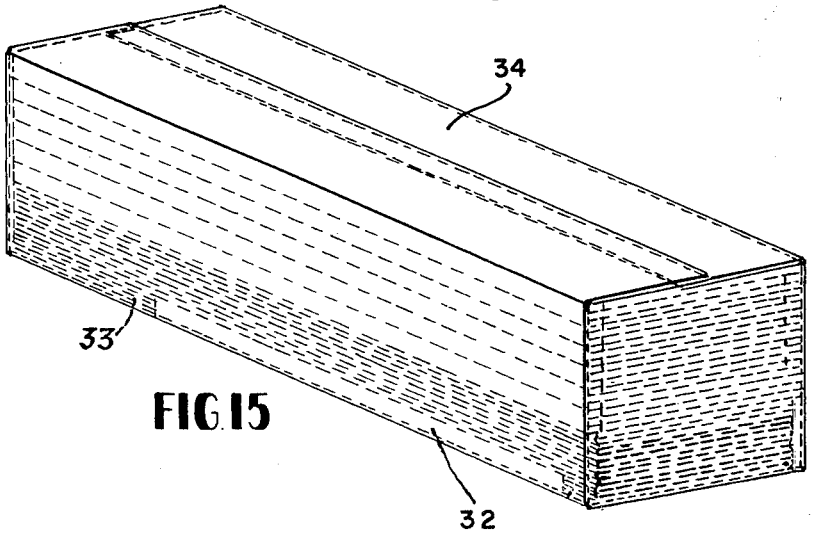
FIG. 15

FIG.22
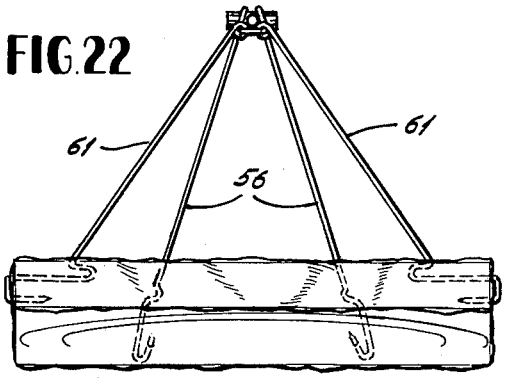
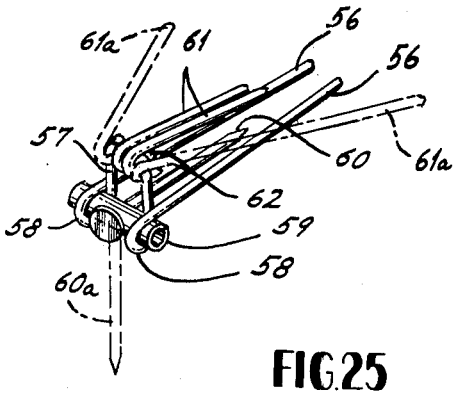
FIG.25
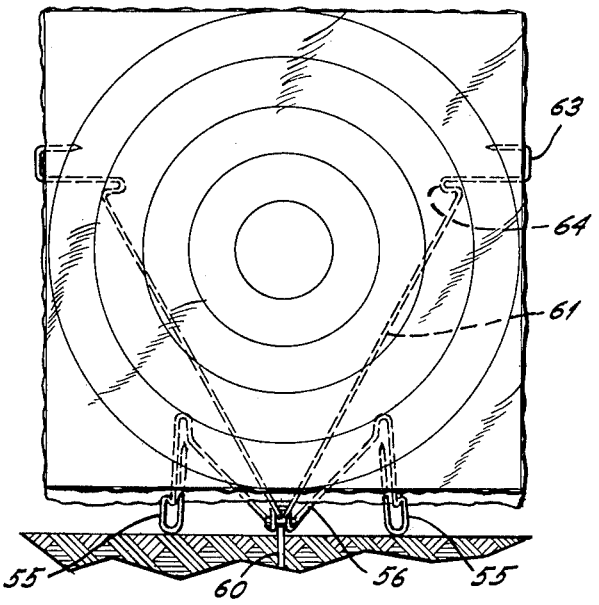
FIG.20
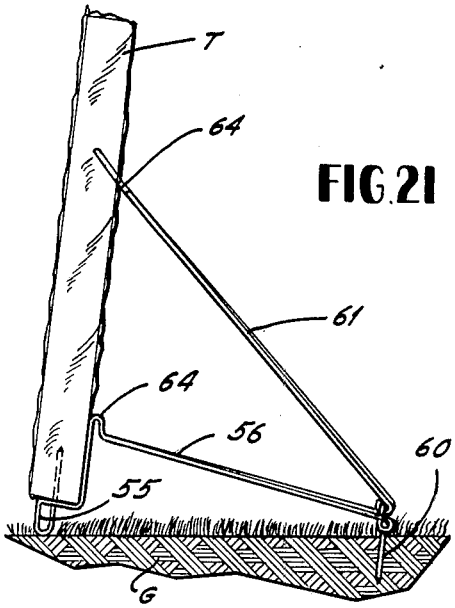
FIG.21
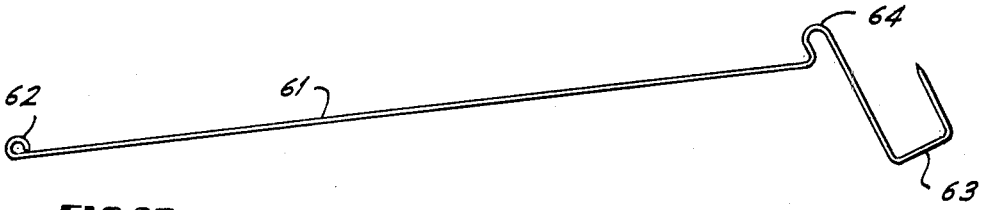
FIG.23
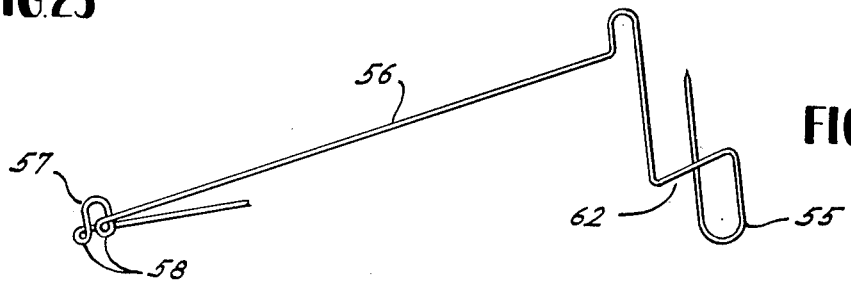
FIG.24

FIG. 26
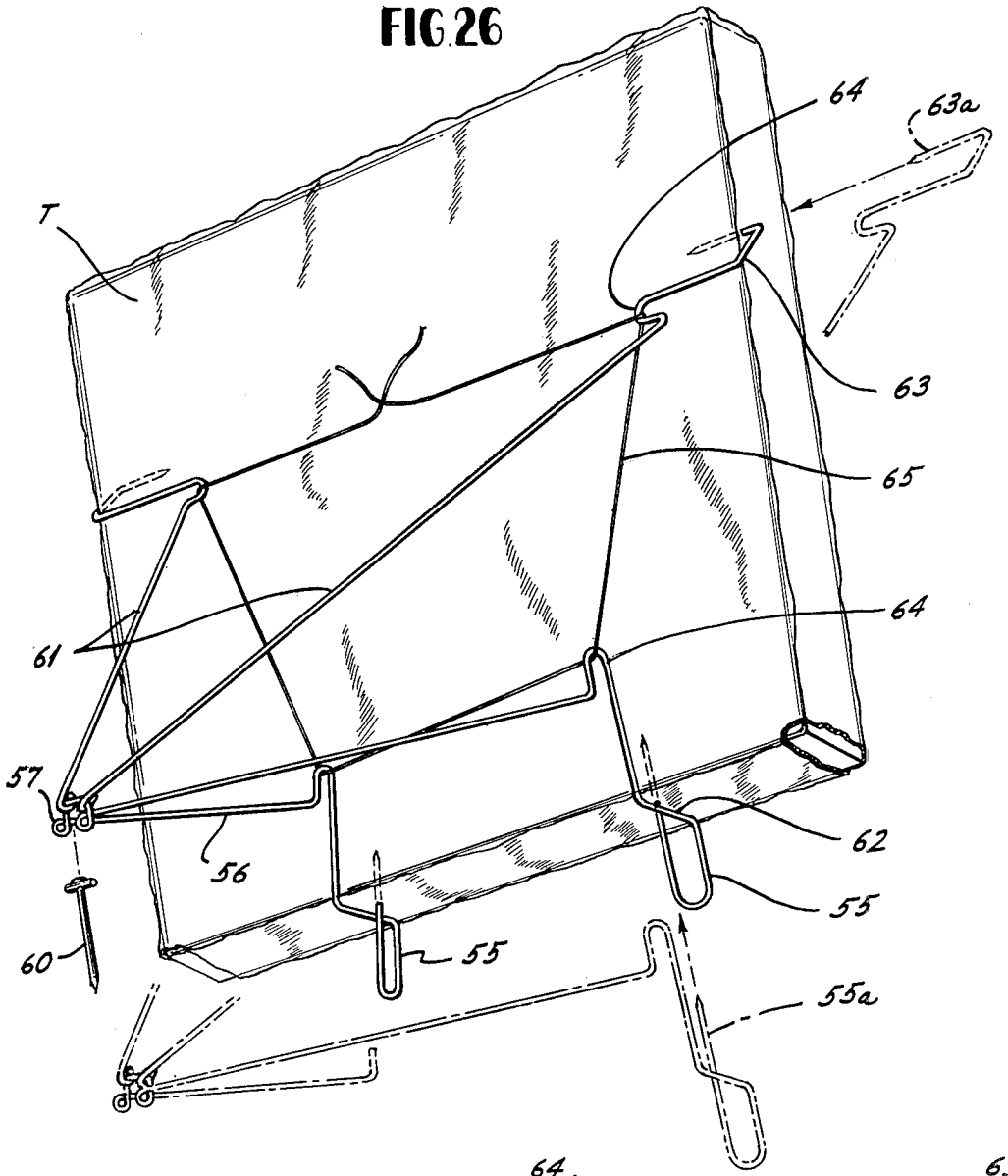
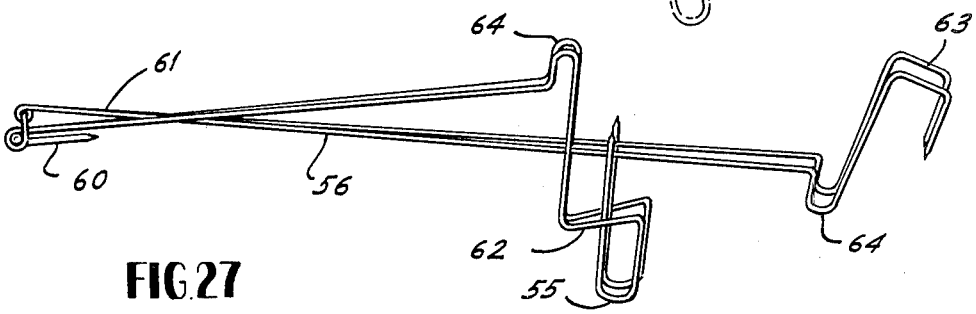
FIG. 27

TARGET PARTICULARLY FOR ARCHERY

CROSS REFERENCES

The present application is a Continuation-in-part of my prior application Ser. No. 726,201, filed Sept. 24, 1976, now U.S. Pat. No. 4,121,959 which is a Continuation-in-part of my prior application Ser. No. 631,893, filed Nov. 14, 1975, and issued Feb. 28, 1978 as U.S. Pat. No. 4,076,246, which in turn is a Continuation-in-part of my prior application Ser. No. 533,942, filed Dec. 18, 1974, now abandoned.

BACKGROUND AND STATEMENT OF OBJECTS

Although the present application is concerned with certain distinctive improvements as compared with the prior applications above referred to, much of the "Background and Statement of Objects" of the parent application Ser. No. 726,201 are applicable here and the pertinent portions are therefore here repeated.

The invention is concerned with a target and while certain features of the target of the invention may be employed as a target for a variety of weapons, the target is particularly suitable for use as an archery target, in which connection the invention is described hereinafter.

Although some archery targets have been formed or constructed in various ways and from a variety of materials, the most common archery targets currently in use are formed of straw or similar materials. Conventional straw targets have a number of disadvantages including the fact that they are very happy and are subject to rotting when exposed to the weather and are also subject to deterioration as a result of infestation by insects.

As commonly constructed, such targets are formed of matted masses of straw which are built up to form the target, a typical target being of the order of three feet in diameter. Targets built up in this manner are bulky, heavy and awkward to transport, package or ship.

In addition to the foregoing, the conventional form of target is a unitary or monolithic structure, and for this reason does not have a high degree of wear resistance, and thus also has a short life. Scoring considerations commonly result in much more numerous strikes in the central area of the target than in the other areas, so that the central area wears and weakens quite rapidly and at a much higher rate than the other areas of the target.

Certain targets have also been made of materials other than straw or the like, for instance certain resin type materials in the form of layers or plies of fabrics, foam and/or panels. In many of these prior forms of targets, the system for absorbing the energy of the arrows contemplates deflection of panel type of elements, at least in a portion of the depth of thickness of the target, and particularly in the region of the back face of the target, thereby preventing penetration of the target by the arrows. In other examples of these resin targets, the energy absorption system utilizes penetrable fabric or foam layers, or both. Although targets of these types constructed of resin materials have certain advantages as compared with the conventional straw targets, for instance improved weather resistance, nevertheless they have not been widely accepted for a number of reasons, including the fact that the energy absorption systems utilized have been highly impractical or inefficient, with consequent necessity for the use of excessive quantities of the resin materials.

With the foregoing in mind, the present invention contemplates the provision of a target of basically different structure according to which various of the disadvantages of the prior targets are eliminated. The target of the present invention may weigh only a small fraction of the weight of a conventional straw target and even considerably less than prior targets formed of resin materials. Moreover, the target of the invention may be formed of materials which are virtually rot and vermin proof regardless of exposure to the weather.

In contrast to prior art targets, the target of the present invention is made up of a multiplicity of plies of what are referred to herein as "membranes", at least some of the membranes being spaced from each other by intervening layers of porous material, the membranes being penetrable by the arrows cast at the target and being formed of elastomeric or resilient and tear resistant material, preferably sheet material having self-healing properties. In this construction, each of the multiplicity of membranes provides for development of a sleeve or annulus of the sheet material of the membranes surrounding the aperture produced by the penetration of an arrow, which sleeve because of the elastomeric characteristic of the sheet material snuggly engages the side wall or shaft of the arrow, thereby frictionally absorbing energy. The use of the porous spacing layers between membranes accommodates the formation of the sleeves referred to. This multiple membrane construction provides a highly efficient energy absorption system and thus provides for great reduction in the weight of materials used.

In contrast to various prior art targets employing the principle of panel deflection in order to absorb the energy of the arrow, the penetrable membrane arrangement of the present invention absorbs the energy by frictional engagement of the arrow shaft by the sleeves of the membrane material surrounding the apertures caused by the penetration. For applicant's purposes, it is important that the penetration occur and that panels, backing layers or target supports which are not penetrable should not be present, even at the back face of the target. The importance of this will be understood when it is kept in mind that typical arrows are 28" long, having 20" of free shaft available for sleeve sliding friction to absorb energy. Therefore, targets according to the invention may be constructed in a manner permitting penetration of the target even to an extent where the arrows project from the rear face.

The present application is particularly concerned with a new form of membrane for use in a target of the kind referred to above, i.e., a target made up of a plurality of membranes at least some of which are interspaced, preferably by porous or foam type material which will permit the formation of the frictional sleeves for engagement of the arrow shaft around the penetration apertures. The improved membrane contemplated for use comprises a membrane having different frictional characteristics at opposite faces or surfaces thereof. More specifically, it is contemplated to employ a membrane having a relatively high coefficient of friction at the surface of the membrane presented toward the front of the target, and having a relatively low coefficient of friction at the surface presented toward the rear of the target.

A membrane having the differential in coefficient of friction as described just above has distinct advantages as compared with other membranes for this purpose. Thus, the sleeves formed around the penetration apertures provide high frictional drag on the shaft of the arrow during penetration, so as to effectively absorb the energy; but upon withdrawal of the arrow from the target, the reverse motion of the shaft causes the sleeves around the penetration apertures to invert in position and project toward the front or face side of the target, and in this position portions of the rear face of the membrane are brought into contact with the shaft of the arrow. Since the back or rear surface of the membrane has a relatively low coefficient of friction, the manual force required to withdraw the arrow from the target is greatly reduced as compared with a membrane having a high coefficient of friction at both sides.

It is noted that substantial force is required to pull the arrow out of the target, and by using a layer or surface of lower friction at the rear face of the membranes than at the front face, it is possible to increase the friction at the front face without increasing the force required to withdraw the arrow.

As will be further explained hereinafter, the membrane having differential coefficient of friction at the front and back faces may be provided in several different ways.

In addition to providing a basically new and efficient system for energy absorption in the target, it is a further object of the invention to provide a target which may readily be assembled from components or sections which are capable of being interchanged so as to multiply the useful center life of the target by at least three.

It is a further object of the invention to provide a mounting device or stand for the target which is collapsible and which is arranged to provide the desired support without blocking penetration of the rear face of the target by the arrows.

The target of the invention is made up of elements and sections which are readily assembled and dissassembled, so that when it is desired to move the target from one location to another it is not necessary to transport it in assembled condition. Moreover, the sectional construction of the target of the invention and the collapsible construction of the target stand provide for compact packaging of both the target and the stand in a common package for convenient shipping, even by parcel delivery service.

In a target made with membranes having different friction characteristics at opposite sides, it is further contemplated to employ visual marking or indicia on the sections or components of the target in order to assure assembly with the surfaces of the membranes having high friction presented toward the face of the target.

BRIEF DESCRIPTION OF THE DRAWINGS

How the foregoing and other objects and advantages are attained will appear more fully from the following description and accompanying drawings, in which:

FIG. 7 is a view similar to FIG. 1 but illustrating a modified form of target enclosure;

FIG. 8 is a top edge view of the arrangement shown in FIG. 7;

FIG. 9 is a fragmentary sectional view taken as indicated by the section line 9—9 on FIG. 7;

FIG. 12 is an isometric view of a stiffening edge frame which may be employed for targets made up according to the present invention, FIG. 12 showing the edge frame in collapsed condition appropriate for shipment;

FIG. 13 illustrates the device of FIG. 12 in partially opened condition;

FIG. 14 illustrates the device of FIGS. 12 and 13 in fully opened condition and applied to a target;

FIG. 15 is an isometric, somewhat diagrammatic view of the various parts of a target stacked together for shipment and surrounded by an appropriate shipping cover;

FIG. 20 is a front elevational view of a target according to the present invention mounted on a stand according to the invention;

FIG. 21 is a side elevational view of the target and the stand;

FIG. 22 is a plan view of the target and stand;

FIGS. 23 and 24 are views respectively illustrating two different stand elements employed in the target stand;

FIG. 25 is an enlarged fragmentary view illustrating the connection between the several elements incorporated in the stand;

FIG. 26 is a perspective rear elevational view of a target with stand elements being applied and indicating the manner of application; and FIG. 27 is a view of the target stand in collapsed condition.

DETAILED DESCRIPTION OF THE DRAWINGS

Figure 6:
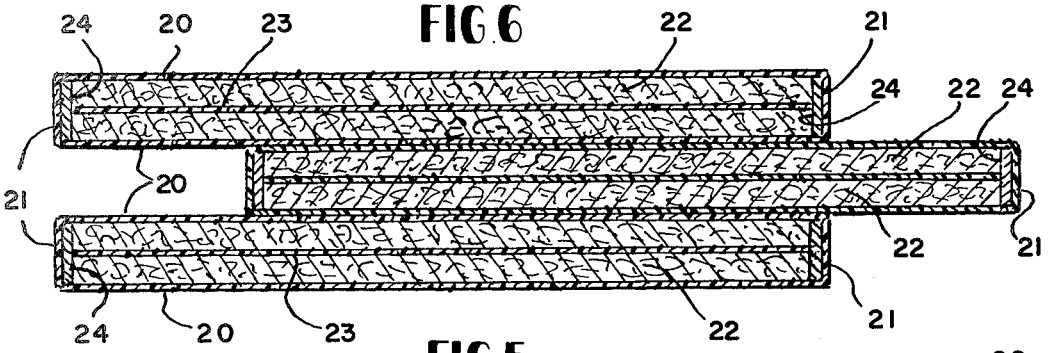
FIG. 6 is a sectional view of the multi-element section of FIG. 5, taken as indicated by the section line 6—6 on FIG. 5.
Figure 5:
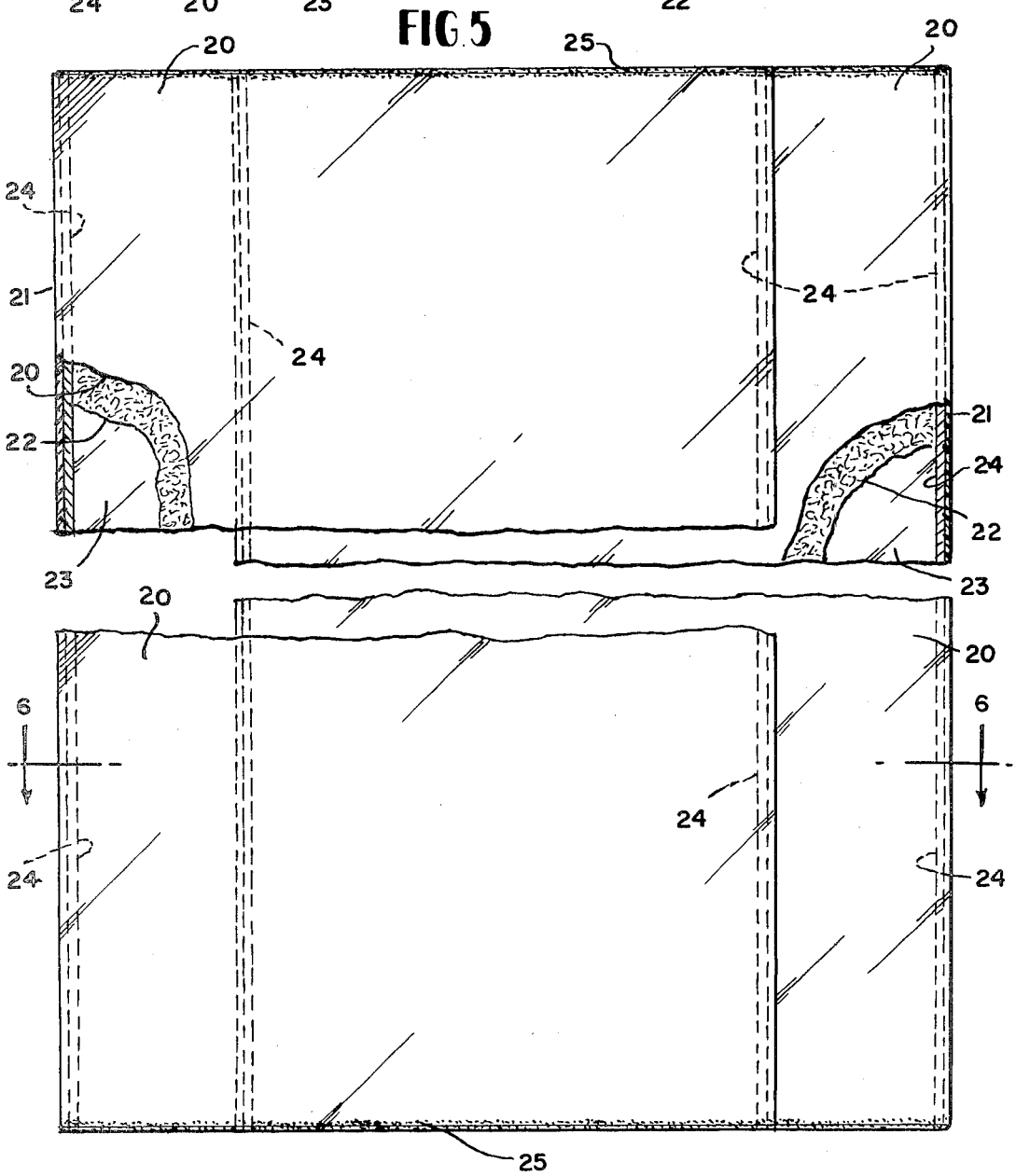
FIG. 5 is an enlarged elevational view of a multi-element section embodying one form of elements according to the invention, the central portion of this view being broken out and certain parts being broken away as will further appear.

As above indicated, the target of the present invention is made up of elements and sections, at least the sections being capable of being assembled and disassembled. The construction of these parts according to one typical embodiment of the invention is illustrated in FIGS. 5 and 6. Before considering those figures in detail, it is first pointed out that in a preferred embodiment of the invention, the various components are made up principally of resin materials. Each component comprises a plurality of penetrable membranes, formed for example of sheet polyethylene which is resilient and tear resistant, together with intervening layers of a porous or low density material, such as polypropylene foam, which is also resilient and tear resistant. As will further appear, the penetrable membranes or sheets of the polyethylene are the primary components acting to arrest the flight of the arrow within the target structure, the porous or foam material being present principally as spacer means between the membranes of polyethylene.

FIGS. 5 and 6 (and also FIGS. 4 and 9) illustrate one general form of the basic components, which I have termed "elements" and from which the components which I have termed "sections" are made up, there being three such elements in each section, as clearly appears in FIG. 6. This particular form of the basic elements may be made up in a variety of ways, for instance by forming a tube or sleeve of sheet polyethylene material enclosing the element and having portions 20,20 serving as penetrable membranes at opposite faces of the elements, and having portions 21,21 at the edges of the elements. Within the sleeve or tube are a pair of layers 22 formed of resilient porous or foam polypropylene, with an additional intervening strip 23 of sheet polyethylene serving as an additional penetrable membrane. Still further, within the edge portions of the element, stiffening strips such as the vulcanized fiber strips 24 are provided in order to contribute stiffness to the element. The strips 24 lie in planes perpendicular to the mean plane of the element and preferably extend throughout the entire length of the element.

The formation of the covering sleeve or tube of the element may be accomplished prior to insertion of the core layers of foam and of the central strip or membrane, but it is alternatively contemplated that the formation of the sleeve or tube be effected continuously from strip material as the parts are assembled.

Figure 1:
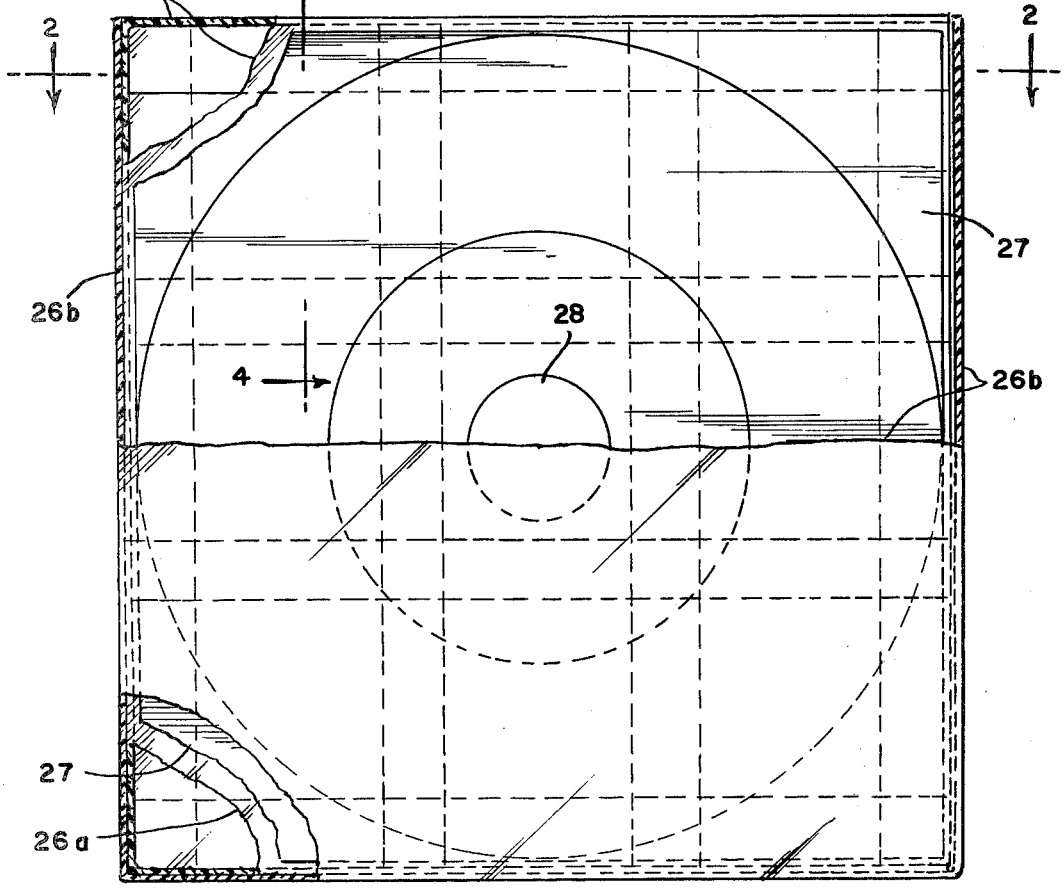
FIG. 1 is a face view of a target according to the present invention, with certain portions broken away to disclose others lying within the target.
Figure 2:
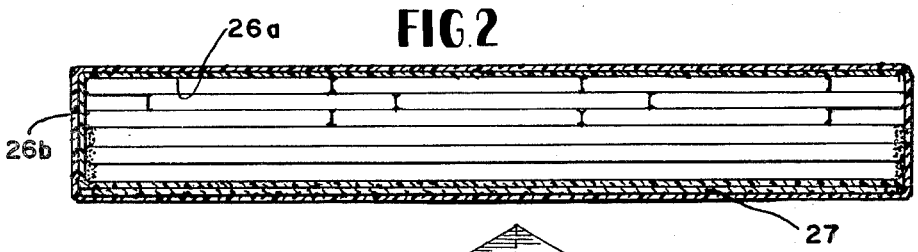
FIG. 2 is a sectional view taken as indicated by the section line 2—2 in FIG. 1, but with various of the elements within the target enclosure shown in elevation instead of in sections.
Figure 4:
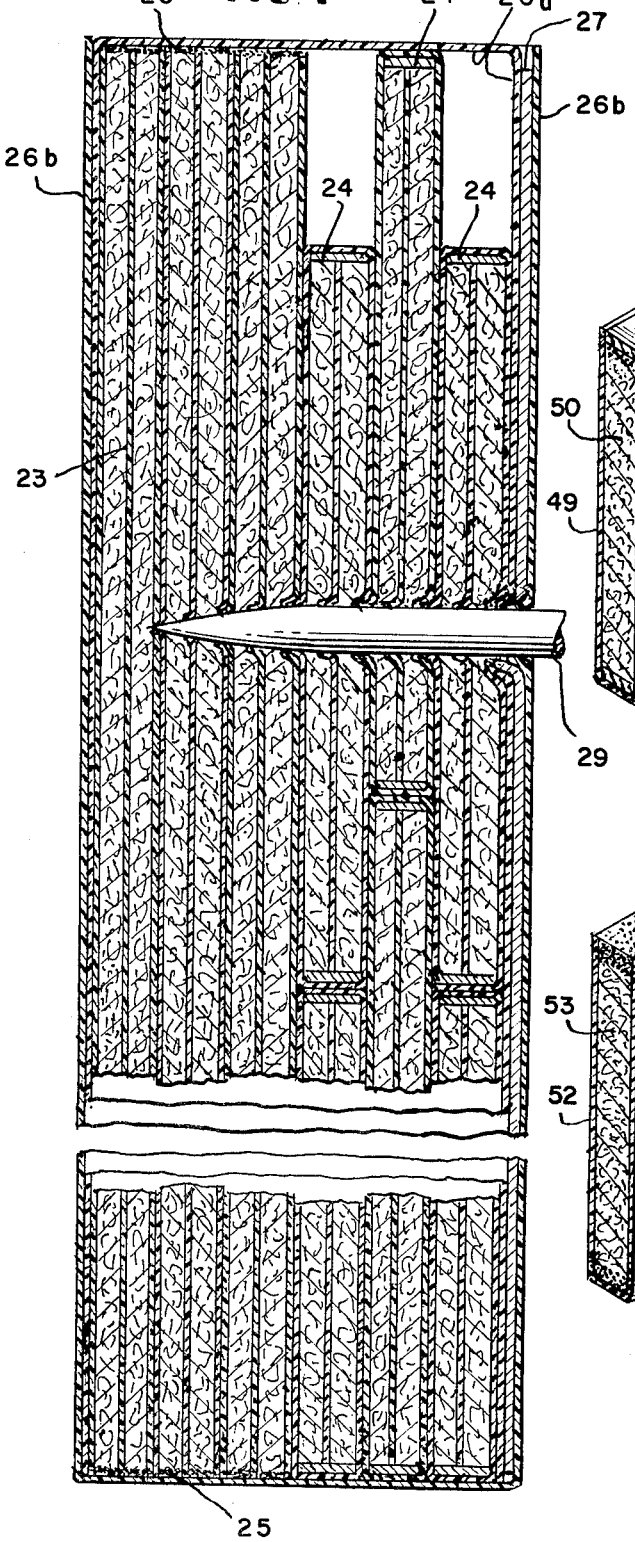
FIG. 4 is an enlarged fragmentary sectional view taken as indicated by the section line 4—4 on FIG. 1 and illustrating the penetration of an arrow into the target.

As will be seen, each element comprises a boardlike piece, and upon the assembly of three such elements in the manner clearly shown on FIGS. 5 and 6, the "section" of the target thereby produced comprises a tongue and groove component adapted to be interleaved or interengaged with other similar sections in edge-to-edge relation in the manner clearly apparent from FIGS. 1, 2 and 4. Staggered edge lap or other arrangements may be used to provide sections which when assembled do not present an area or line along which an arrow could bypass any substantial number of the elements.

Elements may be made up in various other ways as will be described hereinafter with reference to other figures, and a continuous fabricating technique for one type of element is also described in my prior U.S. Pat. No. 4,076,246 with reference to FIGS. 16 to 19 of that patent.

The assembly of three elements which makes up each section of the target may be secured together in any of a variety of ways, for instance by employment of staples or adhesives. One preferred technique for interconnecting the elements embodied in a section is illustrated in FIG. 5. According to this technique, the end portions of the three elements of the section are subjected to heating in order to fuse or heat seal some of the resin material as is indicated at 25,25 at the top and bottom of FIG. 5. In this way, the resin material of the polyethylene sheeting employed and also the resin material of the foam strips will fuse together and thereby interconnect the ends of the three elements included in the section. This fusion will also develop a stiffened layer at the ends, thereby contributing to the stiffness of the sections.

As will be seen from examination of FIGS. 1, 2 and 4, the total target is made up by assembling a plurality of multi-element sections described above in connection with FIGS. 5 and 6. Specifically in connection with the embodiment illustrated, three sections are assembled in each of two parallel planes. As best seen in FIGS. 1 and 2, the three sections assembled in one plane are positioned to extend horizontally of the target and the three sections assembled in the other plane are positioned to extend vertically in the target. This arrangement not only provides stiffness in both directions but also facilitates arrow removal and further reduces line-up of element edges.

Figure 3:
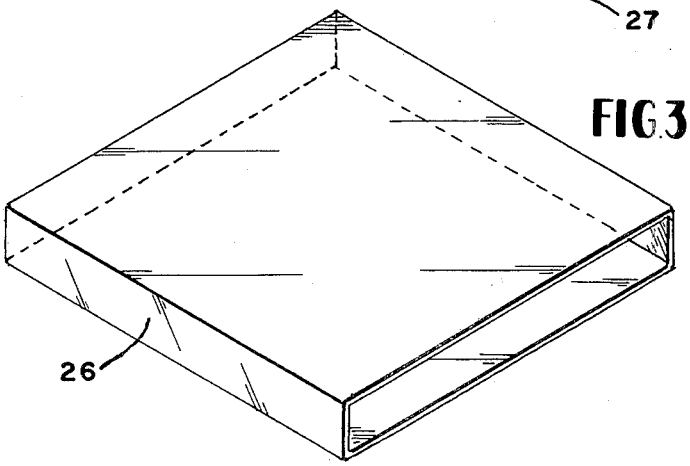
FIG. 3 is an isometric view of one of the open ended enclosure envelopes employed in the target of FIGS. 1 and 2.

The assembled sections of the target are preferably enclosed in some manner to retain them in the desired assembled relation. In the embodiment shown in FIGS. 1 to 6, the enclosure is made up of two envelopes such as shown at 26 in FIG. 3. While these envelopes may be tubular, i.e. open at two opposite ends, as shown they are each open at one end and closed at the other. One of these envelopes is applied as a horizontal envelope as indicated at *26a* in FIGS. 1, 2 and 4, and the other is applied outside of the first as a vertical envelope *26b*. In FIG. 1 the upper portion of the front face of the outer sleeve *26b* has been broken away and removed, thereby disclosing the target face 27 which lies between the front face of the horizontal and vertical envelopes *26a* and *26b*. Preferably at least the outer envelope *26b* is formed of transparent or partial transparent sheet material such as polyethylene, so that the visual markings applied to the target sheet 27, for instance the bull's eye 28 will appear through the outer envelope. The walls of the enclosure envelopes will also serve as membranes contributing to the energy conversion system of the target.

The assembled relation of the various sections in the target will also be apparent from the sectional view of FIG. 4. By assembling and positioning the sections in the manner illustrated and described, the number of points or lines in the total target volume at which an arrow could penetrate without encountering all or substantially all of the membranes or sheets of the resilient and tear resistant resin is reduced to a minimum. Indeed, throughout most of the area of the target, the penetrating arrow will encounter a multiplicity of plies or membranes in the manner indicated by the arrow 29 shown as penetrating the target in FIG. 4.

As clearly shown in FIG. 4 the point of the arrow has penetrated about 5/6 of the distance through the target and in doing so has encountered numerous membranes of the sheet resin material, each such membrane being punctured by the arrow point, and because of the elastomeric or resilient character of the material, the sheet material around each hole spreads and deflects in a manner developing a sleeve projecting toward the rear or back of the target and having surface contact with the arrow and imposing frictional drag upon the arrow point and particularly upon the arrow shaft. It is this snug frictional fit of the sleeve surrounding each aperture which is effective in arresting the motion of the arrow into and through the target. Moreover, the fact that most of the layers of the sheet material are separated by resilient porous or foam resin material provides space and opportunity for each layer of the sheet material to properly form the friction sleeve referred to and also the somewhat conically shaped portion which interconnects the sleeve and the surrounding portions of the membrane. While the porous material will impose some drag upon the shaft of the arrow, the principle drag is supplied by the snug fitting sleeve portions surrounding the aperture formed by penetration of the arrow.

Although in FIG. 4 the arrow is illustrated as penetrating only about 5/6 of the target, it should be understood that it is contemplated that arrows of high velocity and mass may well penetrate entirely through the target and even project for some appreciable distance beyond the rear face of the target. The friction sleeve formed by penetration of the membranes will continue to perform the function of absorbing energy even where the arrow penetrates through and beyond the back face of the target. In this respect, the target of the present invention is in striking contrast to prior targets relying upon deflection of panels or the like within the target in order to absorb the energy of the arrow. If such panels are penetrated, the energy absorption value thereof is virtually destroyed. It is also of significance that since in applicant's system, friction sleeves of the membranes continue to absorb energy even if the arrow completely penetrates and extends beyond the back face of the target, it becomes possible to provide for absorption of a given quantity of energy with less total weight of materials, and this is a factor of considerable importance because of the costs of various of the resin materials useable for these purposes.

In the embodiment of FIGS. 7, 8 and 9, the same type and arrangement of elements and sections is disclosed, but the assembly of the parts is shown as being enclosed in a bag or complete envelope 30, instead of by means of a pair of open ended envelopes applied respectively in horizontal and vertical positions, as in the first embodiment. The envelope of FIGS. 7 to 9 is preferably provided with interengagable lip portions as indicated at 31 which may, if desired, carry a pressure sensitive adhesive in order to seal the envelope around the target, and thus protect the target against weathering.

In FIGS. 12 to 14, there is disclosed a stiffening component adapted to be applied to a target such as shown in FIG. 1 or in FIG. 7. This component may be made of any suitable fiber board, corrugated board or rigid sheet plastic, and preferably consists of a strip 32 of such material completely surrounding the edges of the target and preferably positioned within the enclosing envelope, as appears in FIG. 14. This stiffening element is adapted to be collapsed in the manner shown by FIGS. 12 and 13, so that when completely collapsed (as in FIG. 12) it may readily be inserted in a shipping or packaging carton in which the entire target may be enclosed and shipped when disassembled and packed for shipment. The various sections of the target may simply be stacked one upon the other is indicated by dotted lines in FIG. 15 and the stiffening strip 32 may be assembled with a suitable target face and with the sections, for instance at the bottom of the stack as indicated in FIG. 15. Assembly instructions or the like may be included in the package at 33, and the entire stack of parts enclosed in a carton or by a wrapper, such a carton being indicated at 34 in FIG. 15.

Although in FIGS. 12, 13 and 14 the edge stiffener 32 comprises a unitary strip extended all the way around the edge of the target, it is to be understood that edge stiffening may also be accomplished by means of separate strips at each edge of the target.

It is to be understood that the target is preferably made up of a multiplicity of sections and that these components may be of different width, length and thickness, according to the desired target dimensions. Although the assembly of three tongue and groove sections in each of two layers or planes of the target is here shown, it will be understood that a different number of sections may be assembled in each layer, depending upon the target dimensions and also upon the width dimensions of the sections.

As above noted, the individual elements of which the target sections are made up may have several alternative forms of construction and may be fabricated in various different ways, such as disclosed in parent application Ser. No. 726,201 above referred to.

Figure 10:
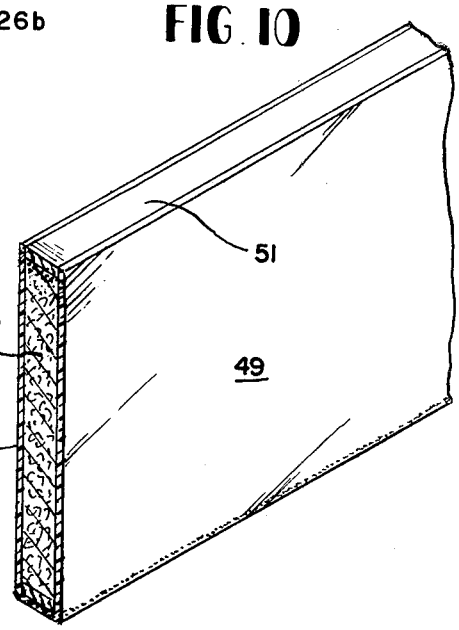
FIGS. 10 and 11 are enlarged fragmentary views of two different forms of elements which may be employed in the building up of targets according to the present invention.

The individual elements may take other forms, for instance as illustrated in FIG. 10 in which side face sheet strips or membranes 49,49 are employed with a porous and resilient core 50, without a central dividing strip or membrane such as shown at 23 in FIG. 6. The edge stiffening strips 51 are heat sealed to the sheets 49 and core 50, which may be done in the manner as described in my patent above referred to.

Figure 11:
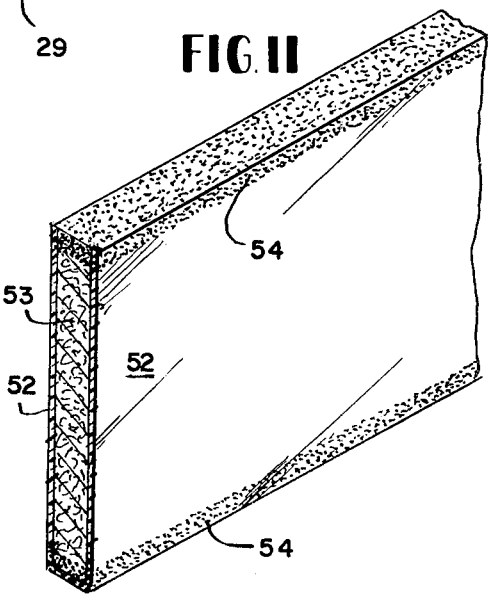

Still another form of element is illustrated in FIG. 11. Here membranes or face sheets 52,52 are again assembled with a porous core 53, but in this case no separate stiffening edge strip is included. Instead, heating sealing of the edge portions is accentuated sufficiently to provide a fused resin strip at the edges, as indicated at 54,54. In this way, the desirable stiffening is accomplished without even inserting a separate strip.

An element of the construction illustrated in FIGS. 5 and 6 and described above may be made by the continuous feed of strip materials from supply sources. The element shown in FIGS. 5 and 6 is made up of a pair of porous strips 22 with a membrane 23 therebetween and with reinforcing strips 24 at opposite edges, all of these internal components being enclosed in a tube of sheet material indicated at 20, having edge portions 21 extended over the reinforcing strips 24 so as to enclose all of the internal components within the tube.

Although such an element may be made by assembling and inserting the internal components into a performed sheet resin tube, in an alternative fabrication technique, all of the internal components may be fed into a hollow mandrel and the enclosing tube may be formed from a flat web of sheet resin material fed to and folded or wrapped around the mandrel and after sealing of the free edges fed beyond the mandrel along with the internal components, thereby providing for formation of the enclosing tube concurrently with the feed of the internal components, as disclosed in my parent application Ser. No. 726,201 above referred to. The resultant composite board element may then be cut to appropriate lengths for making up the sections of the target for instance the tongue and groove type sections fully described above.

Although reference has been made above to the use of certain materials in making targets according to the present invention, it will be understood that certain variations are usable, as is indicated hereinafter.

In the embodiments illustrated in FIGS. 1 to 11, the membranes are formed of sheets or films of polyethylene or any of a number of other similar materials. The materials used are penetrable, elastomeric or resilient, and tear resistant. Thus polyethylene or other plastic films, for instance nylon, vinylidene chloride, or plasticized polyvinyl chloride may be used. Certain well bonded fine and long fiber mats may be used. In all cases the materials should also be self-healing or recoverable. For archery purposes, when using sheet or film resin material for the membranes, the strips of sheet material are advantageously of a thickness of the order of 0.004" (0.1 mm) and with films or sheets of such thickness, it is preferred to employ about 20 piles in the make up of the target. Preferably the total thickness of the piles should be at least 0.08" (2 mm), and this may be provided by employment of at least 10 piles where the individual films are 0.008" (0.22 mm) or by a minimum of 20 piles where the films are 0.004" (0.1 mm) or a minimum of 40 plies where the individual films are 0.001" (0.05 mm). Other thicknesses may be used for purposes other than archery.

In the preceding paragraph regarding the materials employable for the membranes, it should be noted that those materials may have the same coefficient of friction at both faces of the sheets or films employed. However, at least some of the membranes in the embodiments of FIGS. 1 to 11 may have different frictional characteristics at opposite surfaces, and in further explanation of the manner of use of membranes having differrential friction at opposite faces, reference is now made to the embodiments shown in FIGS. 16 to 19.

In the embodiments shown in FIGS. 16 to 19 at least some of the membranes are of "multi-layered" construction, this term being here used to broadly refer to any formation or construction of the membrane providing a surface at one side having a higher coefficient of friction than the surface at the other side. This may be accomplished by "multi-layered" construction of a variety of types, for instance a film or sheet of a resin material one face of which is treated or coated so as to provide a different coefficient of friction on the treated or coated face, as compared with the other face. This type of construction is diagrammatically indicated in FIG. 16, the film or sheet being indicated at f and the coating at c. A coating may be provided to contribute either an increased or a decreased coefficient of friction; in either case the face having the higher coefficient being presented toward the face or front of the target.

On the other hand, a "multi-layered" construction according to the present invention may actually embody two films or sheets of different materials having different friction characteristics, the films or sheets being separately formed and brought together in face-to-face relation. This type of construction is diagrammatically indicated in FIG. 17 in which the two films are indicated at f' and f''. It should be noted in connection with the embodiment of FIG. 17 that the two layers which make up the membrane may be adhesively secured to each other, may be bonded to each other by conjoint extrusion, or may actually be separate films merely positioned and mounted in the target in face-to-face relation without any fastening.

It is here pointed out that in an embodiment of the elements and sections of a target as disclosed in FIGS. 4, 5 and 6 in which each target element is made up of a pair of layers of porous spacing material with an intervening membrane and having an envelope folded around and enclosing the element, it would be preferred to employ a multi-layered membrane having differential friction only for the central membrane between the two porous spacing layers. This preference is based on the fact that with an envelope which is folded to enclose the entire element, the same side of the sheet material would be presented both toward the face and also toward the back of the target, and if the multi-layered differential friction type of sheet material were employed in this situation, at one face of the element, the surface of high friction would be presented in one direction of the target and the surface of low friction would be presented in the opposite direction of the target. However, it is also contemplated as an alternative, that separate enclosing layers of sheet material be provided at the opposite sides of the elements of the target (instead of a single folded sheet around the element), and in this event it is contemplated that the enclosing layers, as well as any interior layers may comprise membranes of multi-layered construction having differential friction.

With target elements of the kinds shown in FIGS. 10 and 11, in which the opposite faces of the elements are provided with separate sheets or layers laminated together with interior porous materials, the sheets or layers at the opposite sides of the elements may of course be of multi-layered construction having differential friction, with the surface of high friction presented toward the face of the target at both sides of the elements and with the surface of low friction presented toward the rear of the target at both sides of the elements.

Figure 18:
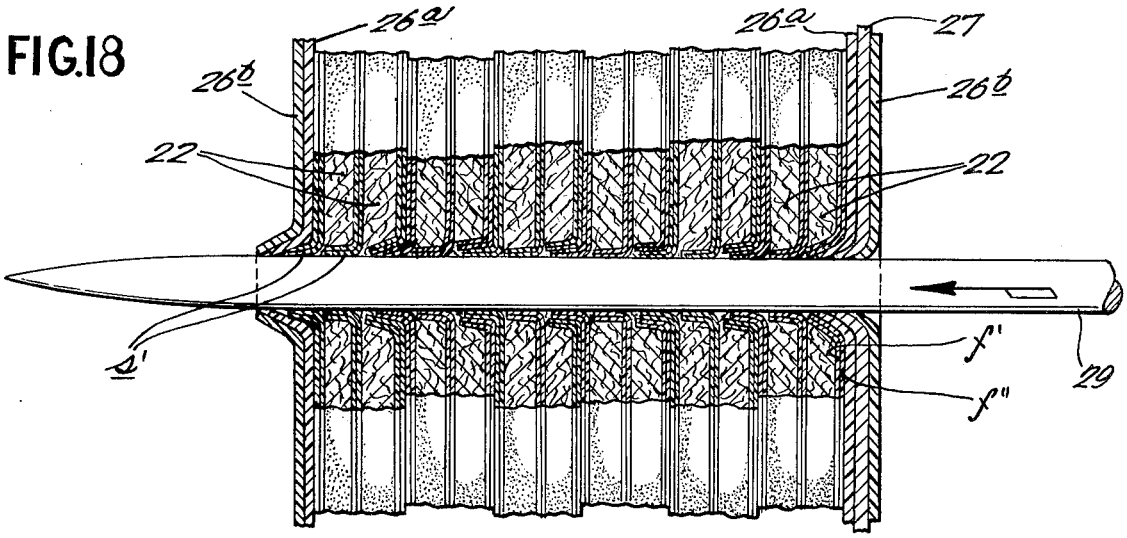
FIG. 18 is a fragmentary sectional view similar to FIG. 4 but illustrating the penetration of an arrow through the entire thickness of a target with membranes constructed according to FIG. 17.
Figure 19:
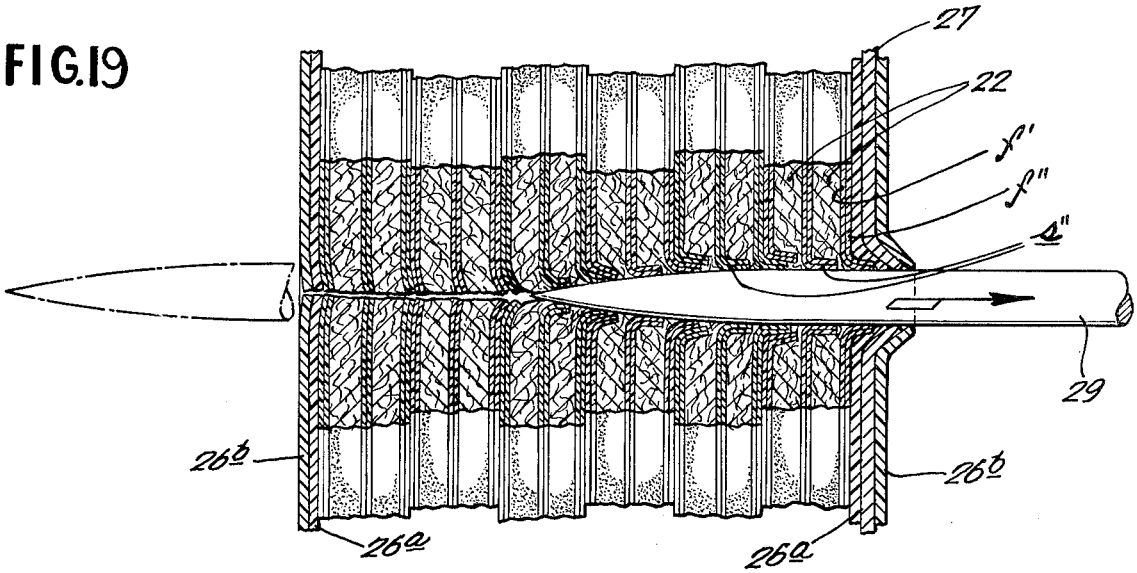
FIG. 19 is a fragmentary sectional view similar to FIG. 18 but illustrating the withdrawal of an arrow from the target.

In the illustrations of FIGS. 18 and 19 which are referred to more fully hereinafter, it is contemplated that all of the membranes (whether interior membranes or enclosing membranes for the target elements) will be formed of sheet material of multi-layered construction having differential friction.

Figure 16:
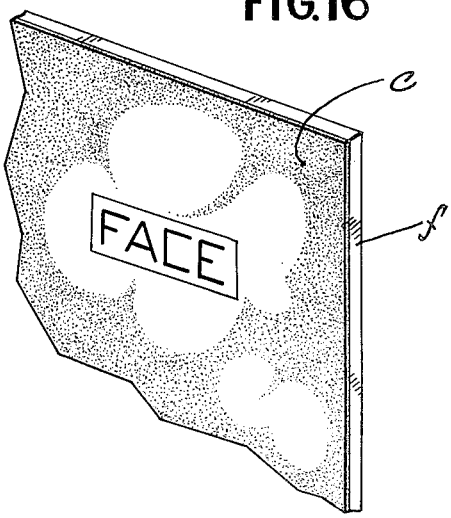
FIG. 16 is an enlarged fragmentary perspective view of a form of membrane constructed according to the present invention so as to have differential coefficient of friction at opposite faces, this form comprising a single film or sheet of material having a coating at one side.

As an example of a multi-layered construction of the kind illustrated in FIG. 16, it is pointed out that such a membrane may be formed of low density polyethylene film one surface of which is coated with a high coefficient of friction elastomer such as natural rubber tackified with pine tar, or coated with urethane rubber, or coated with pressure sensitive acrylic resin such as ethyl hexyl acrylate.

Figure 17:
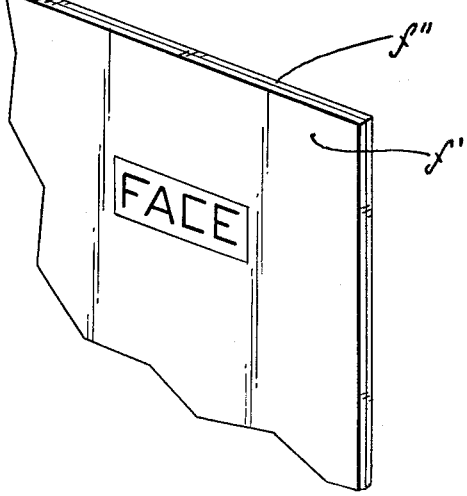
FIG. 17 is a view similar to FIG. 16 but illustrating an alternative membrane formed of two films or sheets of different materials.

As an example of the kind of membrane illustrated in FIG. 17 it is pointed out that there are different types of polyethylene films commonly known by the terms "low slip" polyethylene and "high slip" polyethylene. "Slip" is the industry (National Packaging Institute) term for degree of surface friction controlled by the amount of internal release added to the polymer before extrusion. Slip agents migrate to the film surface when the film cools to the solid sheeted state.

A typical slip agent is Methylene Bis Stearamide known commercially as Acrowax C. For the purposes of the present invention low slip would vary from 0 to 500 parts per million and high slip from 1200 to 1900 parts per million. Both based on polymer weight.

As above mentioned such an assembly of separate films may be adhesively bonded to each other or may even be employed in assembled relation without any bonding.

FIGS. 18 and 19 illustrate in section similar to FIG. 4 a target made with multi-layered membranes of the kind shown in FIG. 17.

FIG. 18 illustrates the action of membranes of the general type shown in FIG. 17, when the arrow 29 penetrates the target in the direction indicated and FIG. 19 illustrates the action when the arrow is withdrawn from the target. The film or sheet f' of each membrane is presented toward the front of the target. Film f' has a relatively high coefficient or friction and portions of the film f' are shown engaging with the shaft of the arrow in the sleeves s' surrounding the penetration apertures.

When the arrow is grasped and withdrawn from the target in the direction indicated in FIG. 19 the sleeves around the penetration apertures reverse or invert in position as shown at s'', thereby bringing portions of the film f'' of each membrane against the shaft of the arrow; and since the films f'' have relatively low coefficient of friction, the withdrawal of the arrow is greatly facilitated.

When employing the type of membranes shown in FIG. 16, the action in the development of the friction sleeves when the arrow penetrates and the reversal of the sleeves when the arrow is withdrawn is essentially the same as depicted in FIGS. 18 and 19.

In addition to facilitating withdrawal of the arrow while maintaining high friction to resist penetration of the arrow the employment of a multi-layered construction according to the present invention is also of advantage in that the deterioration of the membranes is diminished and the membranes and the target have greater useful life.

In order to secure the desired differential frictional action with high friction resisting the penetration of the arrow in the target and the lower friction resisting the withdrawal of the arrow it is of course necessary that the elements and the sections and thus the membranes themselves be positioned in the target with the surface of high friction presented toward the front or "FACE" of the target. Since the target section are desirably interchangeable and capable of being assembled in various interrelated positions, it is contemplated according to the invention that some marking or indicia be applied to the sections in order to facilitate assembly thereof in the desired interrelation. For example as indicated in FIGS. 16 and 17, the word "FACE" may be applied at the side having high coefficient of friction, and this will serve to assure proper assembly.

With respect to the porous or foam spaced material, foamed low density polyethylene or polyolefin, such as polypropylene, of about ¼" (6 mm) thickness and 1.0 lbs. per cubic foot (0.016 gr. per cubic cm) density may be used. However, any porous, soft, tear resistant and resilient material may be employed, including polyethylene foam, flexible urethane foam, or low density mats such as curled hair, cellulose and fiber glass. The material selected should preferably also be self-healing (recoverable). In this specification and in the claims, in referring to the spacer material as being "porous", it is to be understood that this term is not being used in the limited sense requiring the presence of intercommunicating or open pore cells. The material may be either open cell or closed cell porous material and, as already indicated, may even comprise matted or curled fibers or hair, which is also characterized by the presence of interstices or pores. The important factor here is the presence of interstices or pores which can accommodate the development of the friction sleeves surrounding the apertures formed by penetration of the arrow through the membranes, and any "porous" material having appropriate resilience or elastomeric properties will serve this purpose.

Edge stiffeners such as those described above can be formed not only of vulcanized fiber, but also of certain other materials which are impact resistant and preferably which are not likely to be split or shattered it struck by an arrow point. Cellulose board and also various plastic sheet materials may be used, such as high or low density polyethylene, polypropylene and rigid polyvinyl chloride strips. Stiffening strips may be of various thicknesses, for instance about 0.05" (1.25 mm) and will be of width according to the thickness of the element being formed, for instance about (1.25 cm).

In connection with the enclosure for the target, the invention contemplates several alternatives. Thus, where the target is enclosed by a pair of sleeves and where the target face comprises a separate sheet enclosed by at least the outer sleeve, it is contemplated that sheet material, of which the outer sleeve is formed, for instance polyethylene, shall be transparent. If the target face lies between the two sleeves, then the inner sleeve, may be opaque, as by addition of a pigment to the resin material employed.

An enclosure sleeve formed of an opaque resin composition has the advantage of being more resistant to deterioration by exposure to the sun. Alternatively, if the target face is to be viewed through one or both of the enclosure sleeves, resistance to deterioration from sun light may be imparted to the resin composition by incorporation of an ultraviolet light inhibitor in the resin composition.

Still other alternatives in connection with the enclosure or envelope is the use of opaque sheet material, such as polyethylene, and the printing or application of the target face on the outside of the envelope of one or both sides of the target.

Polyethylene sheet resin is a preferred material for the enclosure but certain other resin materials may be employed, including appropriately formulated polyvinyl chloride or polyvinyl fluoride.

Targets made according to the invention are of exceedingly light weight as compared with conventional straw targets. For example a target made according to the invention measuring 3'×3' and of adequate thickness (about 5 or 6 inches) to stop arrows cast by a 60 pound (27 kg) bow, weighs only about 6 pounds (2.75 kg) which is contrasted with a comparable straw mat target weighing about 40 pounds (18.16 kg).

The target of the invention has along life because it is formed of essentially self-healing materials, and also because the positions of the sections are interchangeable in the target, so that different elements and sections may be brought into the zone in which most of the arrows strike.

The target of the invention is highly weather resistant and is also mildew, vermin and insect resistant.

In considering the target stand provided according to the invention, it is first moted that since the target or target butt itself is of relatively light weight, a stand of heavy and cumbersome construction is not needed. Because of the light weight of the target butt itself, the stand may be formed in a very simple manner as will further appear. It is also to be noted that the target stand described below is arranged to leave the back face of the target unobstructed so that the arrows may project through and beyond the back face.

As is illustrated in FIGS. 20 to 27 inclusive, the target stand provided according to the present invention is composed principally of bent wire elements of the kinds shown individually in FIGS. 23 and 24. The wire employed may be about ⅛" in diameter. In FIGS. 20, 21, 22 and 26, the target itself is indicated by the letter T, and this target is of the construction hereinabove fully described, being made up of membranes and intervening porous spacing layers. A three-point of tripod type of support is provided, including a pair of bent wire supporting feet 55, 55 adapted to rest upon the ground indicated at G. These supporting feet are formed at the forward ends of the bracing elements 56 which extend rearwardly from the feet of the target toward each other and which are actually joined and are formed from a common piece of wire, the joint between the two bracing elements 56 being indicated at 57. The wire of the bracing elements 56 is bent into loops 58 interconnecting the bracing elements themselves and the joint 57 which interconnects them. The loops are provided to pivotally receive a transverse rod or tube 59 having a central transverse aperture receiving the spike 60 which serves as the anchoring element for the target stand by being pivoted downwardly to the position indicated at 60*a* in FIG. 25, and driven into the ground G as illustrated in FIGS. 20 and 21. This pivotal arrangement of the spike 60 not only provides for downward projection of the spike to be driven into the ground for outdoor use, but is of importance because in the position where the spike extends horizontally, as shown in full lines at 35, the spike is "retracted" so to speak, which is of advantage when the target is used under certain conditions, particularly indoors, in which event, it may be desirable to utilize sand bags or the like as a weight resting upon the spike to fix the position of the target on any desired surface. The retracted position of the spike is also of importance for packing and shipment.

The joint part 57 serves also as a point of attachment of the upper bracing elements 61, 61 the end portions of each of which are bent to provide an eye 62 through which the joint part 57 extends (see FIG. 23), thereby serving to interconnect all four of the bracing elements 56, 56 and 61, 61.

The spike 60 cooperates with the feet 55, 55 in providing the three-point support system of the target stand.

Each of the foot parts 55 terminate in a free end adapted to be forced upwardly into the materials of the target, in the manner clearly indicated at 55*a* in FIG. 26. The bent part 62 of each of the foot elements is arranged to provide a support under the lower edge of the target.

Similarily, each of the upper bracing elements 61, 61 is provided with a terminal portion 63, adapted to engage an edge of the target and having a free end portion adapted to be forced into the material of the target in the manner clearly indicated at 63*a* in FIG. 26.

In connection with tthe free ends of the portions 55 and 63 of the target, braces which are forced into the material of the target, it is contemplated that appropriate markings be provided at the edges of the target, for instance on the edge stiffening strips, indicating the points of entry, and thereby facilitating assembly of the stand to the target.

The lower and upper bracing elements 56 and 61 also each have a bent loop such as indicated at 64 positioned so that the entire assembly of bracing elements and the target may be fastened together by means of a simple cord 65 wound around the several bracing elements in the manner clearly shown in FIG. 26.

The arrangement and construction of the stand is particularly adapted to the target of the present invention for several reasons including the fact that the stand does not include any backind board or the like behind the target which would interfere with penetration of arrows through the target and projection thereof beyond the rear face of the target. As above pointed out, it is important in the target of the invention (employing the penetrable membranes) that penetration must not be inhibited.

The employment of the target stand as described above with the sectionalized target as described above is of special advantage from the standpoint of packaging and shipment. Thus, with a typical target made up of three sections in each of two layers or planes of the target, the target sections may be packaged in the manner shown for example in FIG. 15, the sections being stacked one upon the other.

The target stand as above described is readily assembled with and removed from the target itself, and the stand may also be collapsed to a substantially flat form or packet as illustrated in FIG. 27. When the target stand is collapsed, various elements of the stand lie substantially in a common plane and do not project beyond an area roughly equivalent to one of the target sections. The stand may therefore be readily accommodated in the same carton as the target sections.

In connection with the erection and collapse of the target stand, attention is called to the fact that in FIG. 25 a portion of the braces 61 including the root end mounting eyes 62 are shown in full lines in the position occupied when the stand is collapsed as in FIG. 27. In FIG. 25, the dot-dash position of these same elements indicated at 61*a* shows the position of the mounting eyes when the stand is erected and fastened to a target butt. From these two positions of the braces 61 and 61*a*, it will be seen that the root end mounting eyes are angularly tilted with respect to each other as between the two positions, and this angular tilt is accommodated by the shape and arrangement of the joint loop 57.

The entire target and stand of the invention is easy to handle, store, set up and transport. For shipping purposes, the components of a 3 ft. (91.5 cm) target and stand may readily be dissambled and stacked and inserted for shipment in a carton adapted to receive a stack of parts measuring 12"×14"×36" (30.5×35.5×91.5 cm).

Another advantage of the present invention lies in the fact that the target face is disposed within the transparent enclosure for the target. This greatly reduces the tendency to tear the target face, which occurs with conventional targets where the target face is located exteriorly of the target. Such exterior location results in an objectionable tendency for the target to be torn as a result of arrows striking the target in angles or positions other than perpendicular to the plane of the target face.

I claim:

1. An archery target comprising an assembly of a multiplicity of superimposed membranes and a multiplicity of layers of resilient and porous material interposed between and serving to interspace the membranes, the assembly having a front or target face and a back face, and said layers and membranes both being penetrable by an arrow cast at the target, and the membranes being resilient and tear resistant, and the layers of resilient and porous material being of greater thickness than the membranes and providing freedom for formation of sleeve shaped portions of the membranes projecting into said resilient and porous layers toward the back of the target during penetration of the arrow and engaging the shaft of the arrow around the penetration apertures and also providing for inversion of the sleeve shaped portions to positions projecting toward the front of the target upon withdrawal of the arrow in the direction opposite to said penetration, the membranes being multi-layered with layers having surfaces of different coefficient of friction exposed in opposite directions in the target, the surface of relatively high friction being exposed on the face of the membrane toward the front of the target and the surface of relatively low friction being exposed on the face of the membrane toward the back of the target, thereby providing greater frictional resistance of the sleeve shaped portions on the shaft of the arrow during penetration of the arrow as compared with the frictional resistance during withdrawal of the arrow.

2. An archery target as defined in claim 1 in which the layers of the membranes comprise a substrate layer exposed at one side of the membrane and a coating layer on the substrate layer exposed at the other side of the membrane, the material of the substrate layer and of the coating having different frictional coefficients.

3. An archery target as defined in claim 2 in which the substrate layer of the membrane comprises polyethylene and in which the coating layer comprises rubber having a higher coefficient of friction than the polyethylene.

4. An archery target as defined in claim 1 in which the layers of the membranes comprise jointly extruded layers of materials having different coefficients of friction.

5. An archery target as defined in claim 1 in which the layers of the membranes are separately formed from materials having different coefficients of friction, the separately formed layers being assembled in face to face relation.

6. An archery target as defined in claim 5 in which the materials of said separately formed layers comprise low slip polyethylene and high slip polyethylene, respectively.

7. An archery target as defined in claim 1 in which at least one of the membrane layers is formed of resilient and tear resistant material in sheet form.

8. An archery target comprising an assembly of components each having at least one membrane penetrable by arrows cast at the target, the assembly having a front or target face and a back face and the components being assembleable in different positions in the assembly, the membranes being resilient and tear resistant, and providing for formation of sleeve shaped portions of the membranes projecting toward the back of the target during penetration of the arrow and engaging the shaft of the arrow around the penetration apertures and also providing for inversion of the sleeve shaped portions to positions projecting toward the front of the target upon withdrawal of the arrow, the membranes being multi-layered with layers having surfaces of different coefficient of friction exposed in opposite directions in the target, the surface of relatively high friction being exposed on the face of the member toward the front or face of the target and the surface of relatively low friction being exposed on the face of the member toward the back of the target, thereby providing greater frictional resistance of the sleeve shaped portions on the shaft of the arrow during penetration of the arrow as compared with the frictional resistance during withdrawal of the arrow, and the components each having indicia on at least one face thereof indicating which faces of the membranes have higher and lower coefficient of friction.

* * * * *

UNITED STATES PATENT AND TRADEMARK OFFICE

CERTIFICATE OF CORRECTION

PATENT NO. : 4,235,444

DATED : November 25, 1980

INVENTOR(S) : Leonard S. Meyer

It is certified that error appears in the above-identified patent and that said Letters Patent are hereby corrected as shown below:

Column 1, line 34 - "happy" should read --heavy--.

Column 9, lines 18, 19, 21 and 22 - "piles" should read --plies--.

Column 12, line 10 - "it" should read --if--.

Column 14, line 7 - "backind" should read --backing--.

Signed and Sealed this

Tenth Day of March 1981

[SEAL]

Attest:

RENE D. TEGTMEYER

Attesting Officer

Acting Commissioner of Patents and Trademarks